US009551478B2

(12) United States Patent
Ohno et al.

(10) Patent No.: US 9,551,478 B2
(45) Date of Patent: Jan. 24, 2017

(54) LIGHTING DEVICE

(71) Applicant: MINEBEA CO., LTD., Kitasaku-Gun, Nagano (JP)

(72) Inventors: Yasuo Ohno, Iwata (JP); Masahisa Nishio, Kakegawa (JP)

(73) Assignee: Minebea Co., Ltd., Nagano (JP)

( * ) Notice: Subject to any disclaimer, the term of this patent is extended or adjusted under 35 U.S.C. 154(b) by 135 days.

(21) Appl. No.: 14/225,548

(22) Filed: Mar. 26, 2014

(65) Prior Publication Data

US 2014/0355269 A1 Dec. 4, 2014

(30) Foreign Application Priority Data

May 31, 2013 (JP) ..... 2013-115451

(51) Int. Cl.

| | |
|---|---|
| ***B60Q 3/04*** | (2006.01) |
| ***F21V 15/00*** | (2015.01) |
| ***B60Q 1/06*** | (2006.01) |
| ***F21V 29/00*** | (2015.01) |
| ***F21V 17/16*** | (2006.01) |
| ***F21V 13/04*** | (2006.01) |
| *F21Y 101/00* | (2016.01) |

(52) U.S. Cl.

CPC ..... *F21V 17/16* (2013.01); *F21V 13/04* (2013.01); *F21V 29/002* (2013.01); *F21Y 2101/00* (2013.01)

(58) Field of Classification Search

CPC ..... F21V 13/04; F21V 17/16; F21V 17/162; F21V 17/164; F21V 29/002; F21V 15/04; F21Y 2101/02

See application file for complete search history.

(56) References Cited

U.S. PATENT DOCUMENTS

| | | | | |
|---|---|---|---|---|
| 8,474,999 | B2 * | 7/2013 | Ou | F21K 9/137 362/249.02 |
| 2005/0201109 | A1 * | 9/2005 | Shimura | F21V 5/007 362/382 |
| 2009/0213595 | A1 * | 8/2009 | Alexander | F21V 19/001 362/373 |
| 2011/0063849 | A1 * | 3/2011 | Alexander | F21S 48/328 362/294 |
| 2012/0051068 | A1 * | 3/2012 | Pelton | F21V 14/04 362/373 |
| 2012/0262928 | A1 * | 10/2012 | Matsuda | F21S 8/026 362/373 |

FOREIGN PATENT DOCUMENTS

| | | |
|---|---|---|
| JP | 2011-151218 A | 8/2011 |
| JP | 2012-104257 A | 5/2012 |

* cited by examiner

*Primary Examiner* — Peggy Neils
*Assistant Examiner* — Erin Kryukova
(74) *Attorney, Agent, or Firm* — Carrier Blackman & Associates, P.C.; Joseph P. Carrier; Jeffrey T. Gedeon

(57) ABSTRACT

There is provided a lighting device includes a first frame, on which a light source unit is mounted, a second frame disposed at a front of the first frame and holding a lens, and a third frame disposed between the first frame and the second frame. The first frame and the second frame are fixed to each other to configure an integral main frame, and the third frame and the main frame are connected to each other via an elastic deformation part to be displaceable relatively in a front-rear direction at a connecting position.

7 Claims, 3 Drawing Sheets

LIGHTING DEVICE

CROSS-REFERENCE TO RELATED APPLICATION

This application claims priority from Japanese Patent Application No. 2013-115451, filed on May 31, 2013, the entire subject matter of which is incorporated herein by reference.

BACKGROUND OF THE INVENTION

1. Field of the Invention

The present invention relates to a lighting device, and more particularly, relates to a lighting device which is suitably used as a lighting unit of a lighting apparatus configured by assembling the lighting unit and an apparatus body.

2. Description of the Related Art

There has been suggested a lighting apparatus (for example, see JP-A-2012-104257) configured by assembling a lighting unit and an apparatus body, and a lighting device (for example, see JP-A-2011-151218) suitably used as a lighting unit. FIG. 5 shows such a lighting apparatus as an example. The lighting apparatus 100 includes a lighting unit 110 having an approximately cylindrical shape, and an apparatus body 120 to which the lighting unit 110 is assembled. The lighting unit 110 includes a frame 101, a light source unit 104, and a lens 105. In the lighting unit 110, the lens 105 is attached to a front side of the frame 101, and the light source unit 104 including a substrate 103 and a light emitting device 102 mounted on a mounting face 103*a* of the substrate 103 is attached to a rear side of the frame 101 such that light emitted from the light emitting device 102 is directed to the front side. The apparatus body 120 includes a ring-shaped housing 112 which surrounds a side surface 106 of the lighting unit 110 when the lighting unit 110 is assembled, a heat radiation member 114 provided to cover an opening of one side of the housing 112.

In the lighting apparatus 100 shown in FIG. 5, the side surface 106 of the frame 101 is provided with a plurality of protrusions 107, and an inner surface 113 of the housing, 112 is provided with engaged portions 115 corresponding to the plurality of protrusions 107, respectively. During the use of the lighting apparatus 100, the lighting unit 110 is assembled in the housing 112 such that each protrusion 107 is engaged with the corresponding engaged portion 115. The lighting apparatus 100 is configured such that the heat radiation member 114 is in contact with a rear surface 103*b* of the substrate 103 when the lighting unit 110 is assembled in the housing 112, so that heat generated from the light emitting device 102 can be efficiently radiated.

However, in the lighting apparatus 100 shown in FIG. 5, if a dimensional accuracy of formation positions of the engaged portions 115 or the protrusions 107 is low, the contact between the heat radiation member 114 and the rear surface 103*b* of the substrate 103 of the light source unit 104 becomes insufficient. That is, for example, a state (partial contact) in which only a part of the rear surface 103*b* is in contact with the heat radiation member 114 may occur. If such a state occurs, the heat generated from the light emitting device 102 cannot be efficiently radiated to the heat radiation member 114, a temperature of the light source unit 104 rises, and a luminous efficiency of the light emitting device 102 is reduced accordingly.

SUMMARY OF THE INVENTION

The present invention has been made in view of the above circumstances. An aspect of the present invention provides a lighting device suitable for a lighting unit in which, when assembled in an apparatus body, a light source unit and a heat radiation member of the apparatus body can be in stable contact with each other.

The following aspects of the present invention are illustrative of the configuration of the present invention, and will be described in respective sections to facilitate the understanding of the various configurations of the present invention. Each section is not intended to limit the scope of the present invention, but while taking into consideration illustrative embodiments of the present invention, replacement, or deletion of a part of the components described in each section, or addition of other components thereto may be included in the technical scope of the present invention.

(1) A lighting device comprises: a first frame, on which a light source unit is mounted; a second frame disposed at a front of the first frame and holding a lens; and a third frame disposed between the first frame and the second frame, wherein the first frame and the second frame are fixed to each other to configure an integral main frame, and the third frame and the main frame are connected to each other via an elastic deformation part to be displaceable relatively in a front-rear direction at a connecting position.

According to the above-described lighting device, the third frame and the main frame are connected to each other via the elastic deformation part, and thereby, can be relatively freely displaced in the front-rear direction at the connecting position. Thus, for example, by connecting the third frame and the main frame while arranging the elastic deformation part continuously or discretely, it is possible to relatively move the third frame and the main frame, as a whole, in the front-rear direction by allowing the elastic deformation part to be deformed in the front-rear direction at the connecting position. At this time, by deforming the elastic deformation part by the amount of deformation different from each other at each connecting position, it is possible to adjust the relative inclination of the main frame and the third frame according to the balance of the deformation amount thereof at each connecting position.

Therefore, in the case where the above-described lighting device is used as a lighting unit of the lighting apparatus configured by assembling the lighting unit and an apparatus body, while providing a positioning reference for positioning the apparatus body in the third frame, the main frame may be displaced with respect to the third frame (adjustment of the inclination and movement in the front-rear direction) thereby being arranged in a desired position relative to the apparatus body even if the positioning accuracy between the third frame and the apparatus body is low.

Accordingly, it becomes usually possible to cause the first frame on which the light source unit is mounted to keep in stable contact with the heat radiation member provided on the rear side of the apparatus body, thereby efficiently transferring heat generated from the light source unit to the heat radiation member. Therefore, it is possible to suppress the temperature rise of the light source unit, so that the luminous efficiency of the light source unit can be improved. In particular, the lighting device is advantageous when the light source unit is configured by a light-emitting diode.

Further, in the above-described lighting device, the main frame is configured by mutually fixing the first frame on which the light source unit is mounted and the second frame for holding the lens. Since the adjustments necessary to cause the first frame on which the light source unit is mounted to come in stable contact with the heat radiation member of the apparatus body is performed by the displacement of the main frame with respect to the third frame, it is possible to achieve the improvement in the luminous efficiency of the light source unit as described above, without changing the relative arrangement of the light source unit and the lens (e.g., distance between the light source unit and the lens), and further without affecting the light distribution of the illumination light emitted from the lighting device.

(2) In the lighting device according to (1), the third frame may have an outer surface including an engagement portion for attaching the lighting device to an external housing.

According to the above-described lighting device, when the lighting device is used as the lighting unit in the lighting apparatus configured by assembling the lighting unit and the apparatus body, it becomes possible to easily configure the lighting unit which is attached to the housing of the apparatus body. At this time, the engagement portion provided on the third frame can be used as a positioning reference for positioning between the housing and the third frame. Further, it is possible to attach the lighting device to the frame of the apparatus body securely and stably by utilizing the elastic force of the elastic deformation part.

(3) In the lighting device according to (1) or (2), the first frame may be formed of a high thermal conductivity material.

According to the above-described lighting device, when the lighting device is used as the lighting unit in the lighting apparatus configured by assembling the lighting unit and the apparatus body, it is possible to further improve the luminous efficiency of the light source unit because heat generated from the light source unit is more efficiently transferred to the heat radiation member of the apparatus body.

(4) In the lighting device according to any one of (1) to (3), the elastic deformation part may be arranged in rotational symmetry about an optical axis.

According to the above-described lighting device, it is possible to perform the relative displacement between the third frame and the main frame in a good balance therebetween. Incidentally, the optical axis refers to a central axis of light distribution of the light emitted from the light source unit. Normally, the optical axis coincides with a geometrical central axis of the light emitting device of the light source unit.

(5) In the lighting device according to any one of (1) to (4), the second frame may have a reflective surface which is an inclined surface configured to reflect light emitted from the light source unit, the reflective surface may be provided with a reinforcement rib at a side of the third frame, the third frame may be provided with an engagement piece at a side of the second frame, and the engagement pieces may be configured to engage with the reinforcement rib to regulate a relative rotation between the main frame and the third frame.

According to the above-described lighting device, by providing the reflective surface in the second frame, the light which is not directly entering the lens among the light emitted from the light source unit is reflected by the reflective surface thereby being incident on the lens, thus, it is possible to improve the utilization efficiency of light emitted from the light source. Further, since the reinforcing rib is provided to the reflective surface of the second frame at the side of the third frame, and the engagement piece for engaging with the reinforcement rib of the second frame is provided to the third frame at the side of the second frame to regulate the relative rotation of the main frame and the third frame, it is possible to improve the assembly performance and the structural stability of the lighting device.

(6) In the lighting device according to any one of (1) to (5), the third frame may include a pin protruding toward the first frame, and the elastic deformation part may be a spring washer disposed to the pin.

According to the above-described lighting device, a mechanism for connecting the main frame and the third frame via the elastic deformation part can be formed easily and inexpensively.

(7) In the lighting device according to any one of (1) to (6), the lens may be a Fresnel lens.

According to the above-described lighting device, it is possible to realize the desired light distribution with a thin and light structure.

According to the above configuration, in the lighting apparatus configured by assembling the lighting unit and the apparatus body, it is possible to provide the lighting device suitable for the lighting unit which causes the light source unit and the heat radiation member of the apparatus body to keep in stable contact with each other when assembled with the apparatus body.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Figure 1:
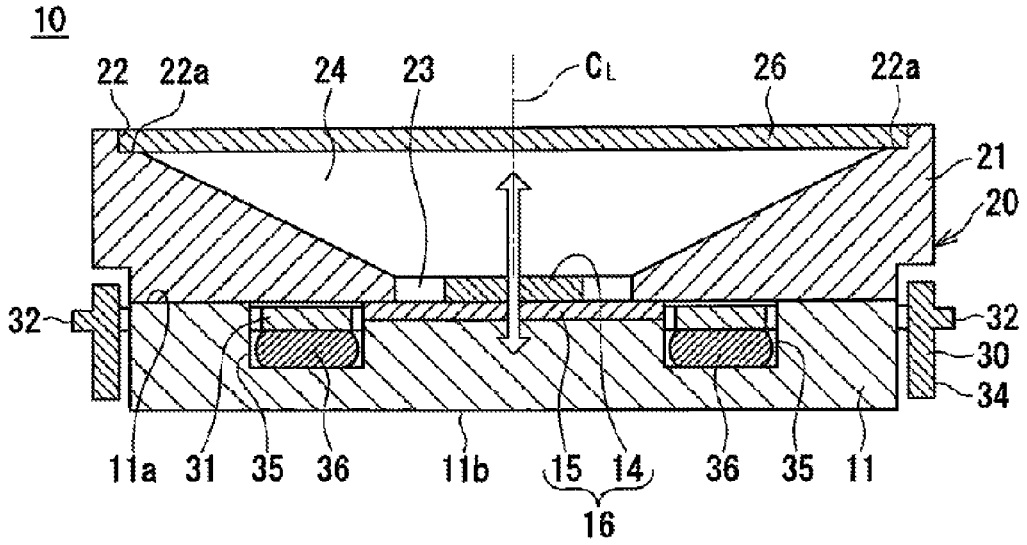
FIG. 1 is a sectional view showing a main part of a lighting device according to a first illustrative embodiment of the present invention.

Hereinafter, illustrative embodiments of the present invention will be described with reference to the accompanying drawings. FIGS. 1 to 4 showing a lighting device are all schematic views showing only a main part thereof. Accordingly, a lighting device according to each of the illustrative embodiments may include other components which are not shown. Further, the relative dimensions of the respective portions are given just to highlight the features for ease of explanation and do not necessarily reflect the actual scales.

A lighting device 10 according to a first embodiment of the present invention includes a first frame 11 on which a light source unit 16 is mounted, a second frame 21 which is disposed at a front of the first frame 11 and holds a lens 26, and a third frame 30 which is disposed between the first frame 11 and the second frame 21. In the lighting device 10, the first frame 11 and the second frame 21 are fixed to each other to configure an integral main frame 20, and the third frame 30 and the main frame 20 are connected to each other via an elastic deformation part 36.

In the lighting device 10, the light source unit 16 is provided with a light emitting device 14 having a circular shape, and a mounting substrate 15 having a rectangular shape for mounting the light emitting device 14. The light emitting device 14 is configured such that a plurality of LED chips (not shown) configured to emit blue light is sealed by a resin material in which yellow phosphor is dispersed, thereby emitting white light. The mounting substrate 15 is formed of a high thermal conductivity material such as aluminum or the like.

Here, in the lighting device 10, the direction in which the light source unit 16 emits light (the direction toward the light emitting device 14 from the mounting substrate 15) is referred to as a front direction and the reverse direction is referred to as a rear direction. Regarding each component of the lighting device 10, the surfaces at the front side and the rear side are referred to as a front surface and a rear surface, respectively. Further, an optical axis refers to a central axis of light distribution of the light emitted from the light source unit 16. In the lighting device 10, the optical axis coincides with the geometric central axis of the circular light emitting device 14.

In the lighting device 10, the first frame 11, second frame 21, and third frame 30 are disposed coaxially with each other to be formed in a shape having a substantially circular appearance when viewed from the front. Hereinafter, a common central axis is designated by a reference symbol $C_L$. The light emitting source unit 16 is mounted on the first frame 11 such that the central axis of the light emitting device 14 (i.e., the optical axis) coincides with the central axis $C_L$ of the first frame 11. Accordingly, the optical axis is also designated by the reference symbol $C_L$.

The first frame 11 is formed in a flat cylindrical shape with a high thermal conductivity material such as aluminum or the like. The light source unit 16 is mounted on a central portion of a front surface 11*a* of the first frame 11. When the lighting device 10 is assembled in the apparatus body 45 shown in FIG. 2 (described later), the rear surface 11*b* of the first flame 11 functions as a heat transfer surface which is in contact with the heat radiation member 42 of the apparatus body 45. The first frame 11 is formed at the front surface 11*a* with recesses 35 for accommodating the elastic deformation part 36 at an outer peripheral side than the region on which the light source unit 16 is mounted. In the lighting device 10, in addition to the two recesses 35 shown in FIGS. 1 and 2, two recesses 35 are formed at positions rotated by 90° about the central axis $C_L$ from the respective positions of the recesses 35.

The second frame 21 is formed in a flat cylindrical shape using a white resin having high light reflectivity, and is disposed coaxially with the first frame 11 at the front of the first frame 11. A first opening 22 of a circular shape is formed at the front surface side of the second frame 21, and a second opening 23 of a circular shape having a smaller diameter than the first opening 22 is formed at the rear surface side thereof. A step portion 22*a* is formed at an inner edge of the first opening 22, and the lens 26 having a circular plate shape is disposed on the stepped portion 22*a* and held in the second frame 21 by any suitable means. At this time, in the lighting device 10, the lens 26 is disposed such that its optical axis coincides with the optical axis $C_L$ of the lighting device 10 as described above.

When the lighting device 20 is assembled, the light emitting device 14 of the light source unit 16 is exposed from the second opening 23 of the second frame 21. Further, in the inner side of the second frame 21, a reflective surface 24 is formed between the first opening 22 and the second opening 23, as an inclined surface of a conical shape inclined to be expanded toward the front side.

Figure 2:
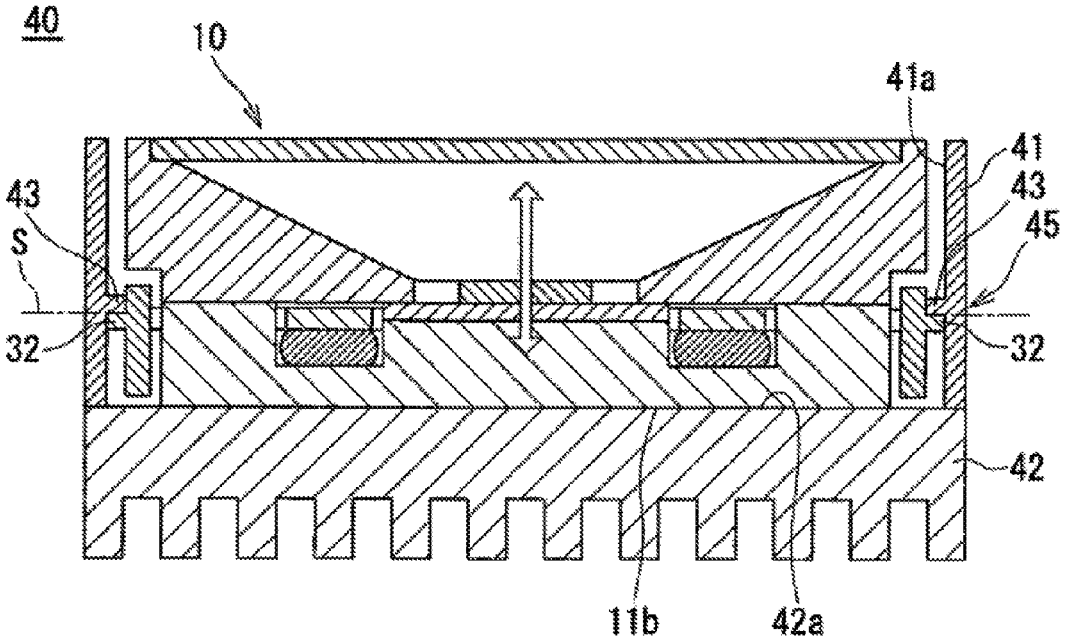
FIG. 2 is a sectional view showing a lighting apparatus in which the lighting device shown in FIG. 1 is assembled as a lighting unit in an apparatus body.

The third frame 30 is formed of a white resin, and includes a flat portion 31 and an outer surface portion 34 having a cylindrical shape provided outside the flat portion 31 such that a cross section of the third frame 30 has a flat H-shape. The outer surface portion 34 of the third frame 30 is formed to cover the substantially entire area of the outer surface of the first frame 11 and a portion of the rear side of the outer surface of the second frame 21. Further, the outer surface portion 34 is provided thereon with the engagement portions 32, as the protrusions projecting outwardly, for mounting the lighting device 10 to an external housing (for example, a housing 41 of the apparatus body 45 as shown in FIG. 2). In the lighting device 10, in addition to the two engagement portions 32 shown, two engagement portions 32 are provided at positions rotated in a 90° are about the central axis $C_L$.

The lighting device 10 is configured by fixing the first frame 11 on which the light source unit 16 is mounted and the second frame 21 holding the lens 26, in a state where the third frame 30 is sandwiched between them. Further, the fixing is performed in the state where the elastic deformation part 36 is accommodated in the recess 35 of the first frame and the third frame 30 is disposed such that a part of the third frame covers the elastic deformation part 36 from the front thereof. In the lighting device 10, the elastic deformation part 36 may be a block-shaped or ring-shaped elastic member (for example, rubber, sponge, and the like).

In the lighting device 10 configured as described above, the main frame 20 and the third frame 30 configured by fixing the first frame 11 and the second frame 21 are connected to each other via the four elastic deformation parts 36, and can be relatively displaced in the front-rear direction at each connecting position. Thus, by deforming the elastic deformation part 36 in the front-rear direction at each connecting position, the third frame 30 and the main frame 20 can be moved relatively, as a whole, in the front-rear direction (in the direction indicated by the thick arrow shown in the drawing). At this time, by deforming the elastic deformation part 36 by the amount of deformation different to each other at each position, the relative inclination between the third frame 30 and the main frame 20 can also be adjusted in accordance with the balance of the deformation amount.

As shown in FIG. 2, in the case where the above-described lighting device 10 is used as a lighting unit (same reference numeral 10 is attached thereto) of the lighting apparatus 40 configured by assembling the lighting unit and an apparatus body, the effects are as follows. Herein, the lighting apparatus 40 includes the lighting unit 10 and the apparatus body 45 in which the lighting unit 10 is assembled. The apparatus body 45 includes the housing 41 having an annular shape surrounding the periphery of the lighting unit 10 when assembled, and the heat radiation member 42 which is provided to cover an opening of one side of the housing 41.

Further, engaged portions 43 are provided on the inner surface 41*a* of the housing 41 to correspond to respective engagement portions (protrusions) 32 provided on the third frame 30 of the lighting unit 10. Accordingly, when the lighting apparatus 40 is used, the lighting unit 10 is assembled in the housing 41 such that each of the engagement portions 32 is engaged with the corresponding engaged portion 43 at the front side of the engagement portion 32. Thus, in the lighting apparatus 40, the contact surface between the engagement portion 32 of the lighting unit 10 and the engaged portion 43 of the housing 41 becomes a positioning reference S for positioning the lighting unit 10 relative to the apparatus body 45.

At this time, in the lighting unit 10 using the lighting device according to the present illustrative embodiment, even if the positioning accuracy defined by the engagement portions 32 and the engaged portion 43 is low, it is possible to allow the main frame 20 to be displaced with respect to the third frame 30 (adjustment of movement and inclination in the front-rear direction), so that the lighting unit 10 can be arranged at a desired position relative to the apparatus body 45.

Accordingly, it becomes possible to cause the first frame 11 on which the light source unit 16 is mouthed to become in stable contact with the heat radiation member 42 provided on the rear surface side of the apparatus body 45, so that heat generated from the light source unit 16 is transferred efficiently to the heat radiation part 42 of the apparatus body 45. Therefore, it is possible to suppress the temperature rise of the light source unit 16, so that the luminous efficiency of the light source unit 16 can be improved. Here, as in the lighting device 10, it is particularly advantageous when the light emitting device 14 of the light source unit 16 is configured by light emitting diodes.

Further, in the lighting device 10, the main frame 20 is configured by mutually fixing the first frame 11 on which the light source unit 16 is mounted and the second frame 21 which holds the lens 26. Since the adjustments necessary to cause the first frame 11 on which the light source unit 16 is mounted to come in stable contact with the heat radiation member 42 of the apparatus body 45 is performed by the displacement of the main frame 20 relative to the third frame 30, it is possible to achieve an improvement in the luminous efficiency of the light source unit 16 as described above, without changing the relative arrangement of the light source unit 16 and the lens 26 (e.g., the distance between the lens 26 and the light source unit 16) and further without affecting the light distribution of the illumination light emitted from the lighting device 10.

In the lighting device 10, since the four elastic deformation parts 36 are arranged in rotational symmetry about the optical axis $C_L$, it becomes possible to perform the relative displacement of the third frame 30 and the main frame 20 to achieve a good balance therebetween.

Further, the lighting apparatus 40 as shown in FIG. 2 is suitably used as a so called down-light for illuminating a room from a ceiling in a state where the apparatus body 45 installed in the ceiling, and the lighting unit 10 is assembled in the apparatus body 45. However, since the lighting unit 10 has a structure where each of the engagement portions 32 is provided within the housing 41 to be engaged with the corresponding engaged portion 43 at the front side (at a lower side, in this example), even though the elastic deformation part 36 is provided therein, the drop resistance performance of the lighting unit 10 is not lowered as compared with the conventional lighting unit. Rather by utilizing the elastic force of the elastic deformation part 36, it is possible to stably and securely attach the lighting unit 10 to the apparatus body 45.

Figure 3:
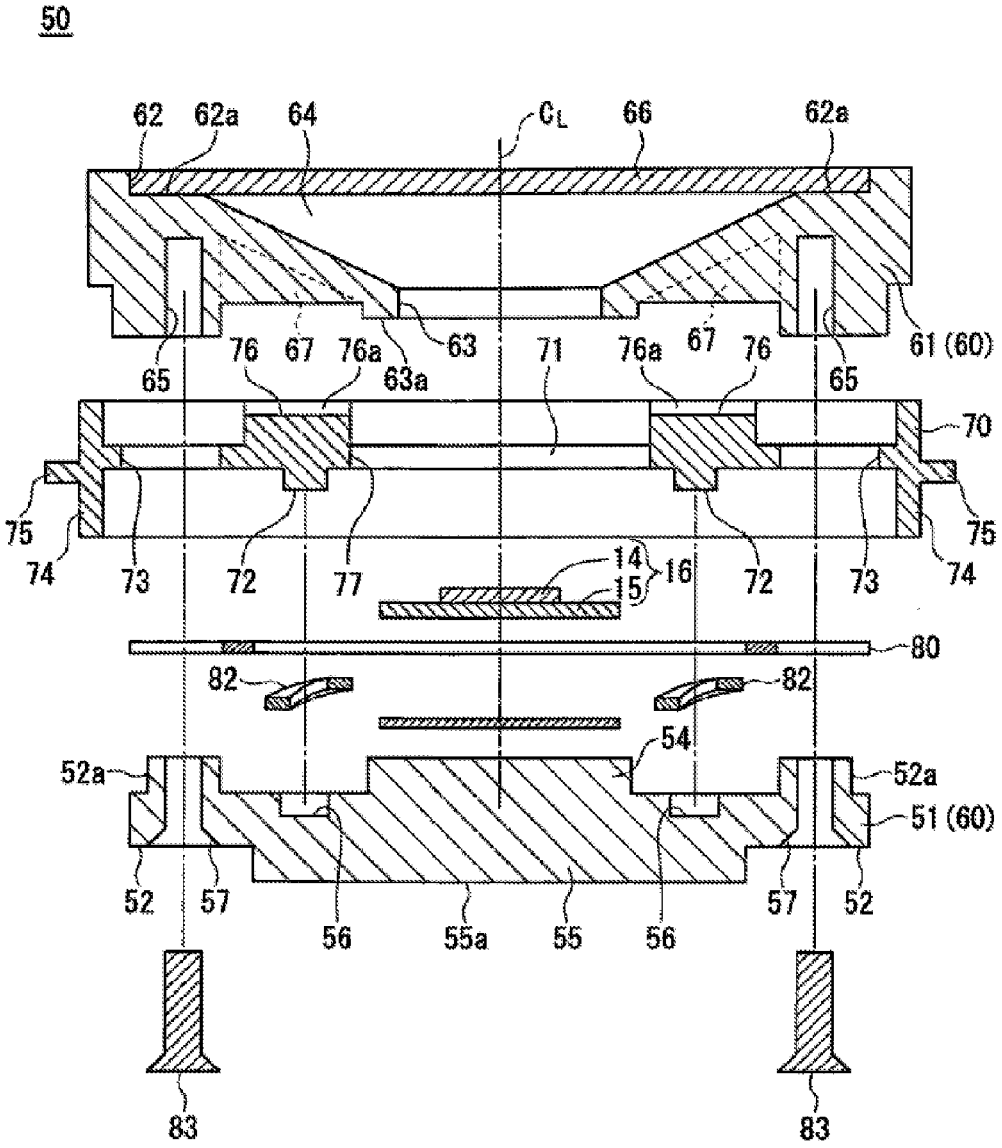
FIG. 3 is a sectional view showing an exploded state of a main part of a lighting device according to a second illustrative embodiment of the present invention.
Figure 4:
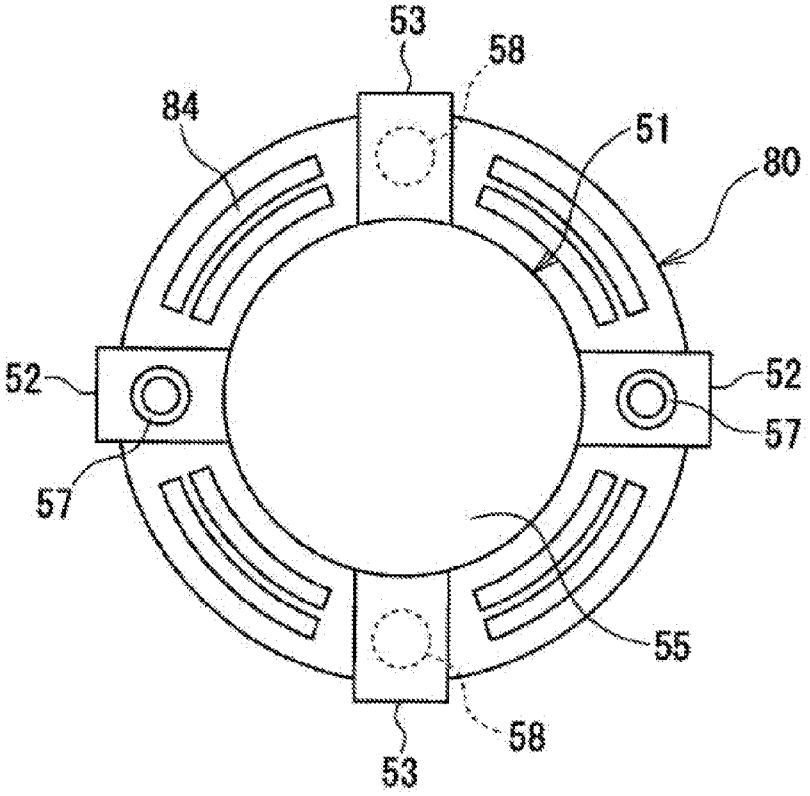
FIG. 4 is a plan view showing an assembled state of a relay substrate and a first frame in the lighting device shown in FIG. 3, as viewed from a rear side thereof.
Figure 5:
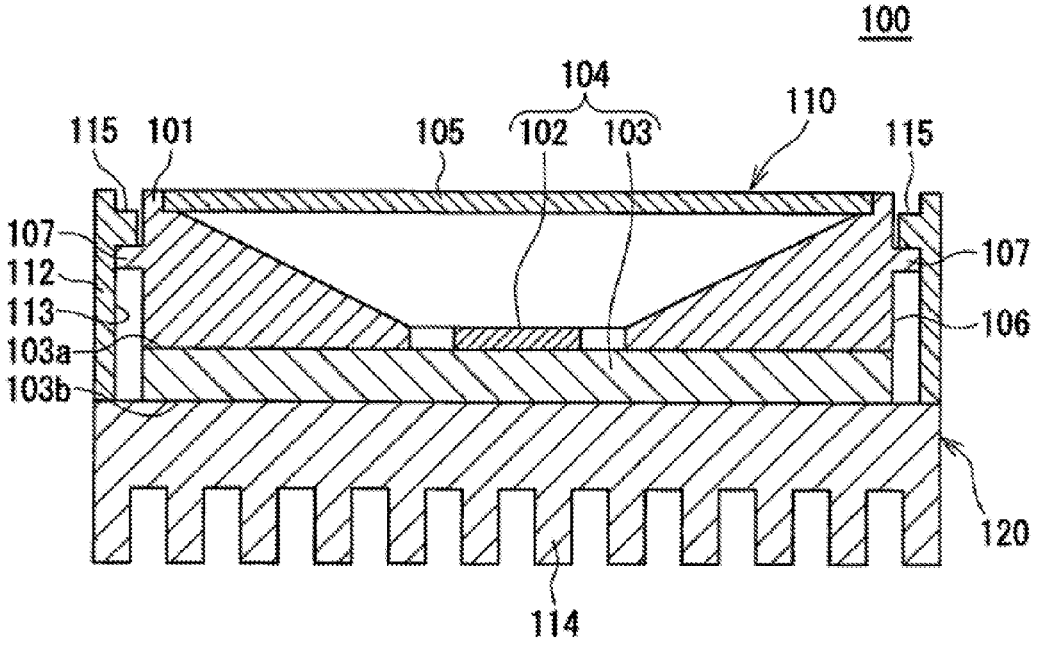
FIG. 5 is a sectional view showing a related-art lighting device.

Next, a lighting device 50 according to a second illustrative embodiment of the present invention will be described with reference to FIGS. 3 and 4. Herein, FIG. 3 is a sectional view showing an exploded state of main parts of the lighting device 50, and FIG. 4 is a plan view showing an assembled state of a relay substrate 80 and a first frame 51 in the lighting device 50 shown in FIG. 3, as viewed from the rear side thereof. The lighting device 50 includes the first frame 51 on which the light source unit 16 is mounted, a second frame 61 disposed at the front of the first frame 51 to hold a Fresnel lens 66 as a lens according to the present illustrative embodiment, and a third frame 70 disposed between the first frame 51 and the second frame 61. As will be described later, the first frame 51 and the second frame 61 are fixed to each other to configure an integral main frame 60, and the third frame 70 and the main frame 60 are connected to each other via, a spring washer 82 as an elastic deformation part according to the present illustrative embodiment.

In the lighting device 50, the light source unit 16 is provided with a light emitting device 14 having a circular shape, and a mounting substrate 15 having a rectangular shape for mounting the light emitting device 14. The light emitting device 14 is configured such that a plurality of LED chips (not shown) configured to emit blue light is sealed by a resin material in which a yellow phosphor is dispersed, thereby emitting white light. The mounting substrate 15 is formed of a high thermal conductivity material such as aluminum or the like.

Here, in the lighting device 50, the direction in which the light source unit 16 emits light (the direction toward the light emitting device 14 from the mounting substrate 15) is referred to as a front direction and its reverse direction is referred to as a rear direction. Regarding each component of the lighting device 50, the surfaces at the front side and the rear side are referred to as a front surface and a rear surface, respectively. Further, an optical axis refers to a central axis of light distribution of the light emitted from the light source unit 16. In the lighting device 50, the optical axis coincides with the geometric central axis of the circular light emitting device 14.

In the lighting device 50, the first frame 51, second frame 61, and third frame 70 are disposed coaxially with each other to be formed in a shape having a substantially circular appearance when viewed from the front. Hereinafter, a common central axis is attached with reference symbol $C_L$. The light emitting source unit 16 is mounted on the first frame 51 such that the central axis of the light emitting device 14 (i.e., the optical axis) coincides with the central axis $C_L$ of the first frame 51. Accordingly, the optical axis is also designated by reference symbol $C_L$.

The first frame 51 is formed in a flat cylindrical shape with a high thermal conductivity material such as aluminum or the like. A first seat portion 54 of a prism shape is formed on the central portion of the front surface of the first frame 51, and a second seat portion 55 of a cylindrical shape is formed on the central portion of the rear surface side thereof. The first frame 51 includes four arm portions 52, 53 at the outer periphery side thereof (see FIG. 4). The arm portions 52, 53 are arranged in rotational symmetry about the central axis $C_L$ of the first frame 51. The countersinking hole 57 into which a flat head screws 83 is inserted from the rear side thereof is formed in the two arm portions 52 opposing each other among the arm portions 52, 53.

The light source unit 16 is mounted on the first seat portion 54 of the first frame 51. When the lighting device 50 is assembled in the apparatus body 45 shown in FIG. 2, a rear surface 55*a* of the second seat portion 55 functions as a heat transfer surface which is in contact with the heat radiation member 42 of the apparatus body 45. The outer diameter of the second seat portion 55 is set such that the second seat portion 55 is a little larger than the first seat portion 54, and a recess 56 for movably receiving a pin 72 (described later) of the third frame 70 is formed at the front surface side of the second seat portion 55.

The second frame 61 is formed in a flat cylindrical shape using a white resin having a high light reflectivity, and is disposed coaxially with the first frame 11 at the front of the first frame 51. A first opening 62 of a circular shape is formed at the front surface side of the second frame 61, and a second opening 63 of a circular shape having a smaller diameter than the first opening 62 is formed at the rear surface side thereof. A step portion 62*a* is formed at an inner edge of the first opening 62, and the Fresnel lens 66 having a circular plate shape is disposed on the stepped portion 62*a* and held in the second frame 61 by any suitable means. At this time, in the lighting device 50, the Fresnel lens 66 is disposed so that its optical axis coincides with the optical axis $C_L$ of the lighting device 10 as described above.

When the lighting device 50 is assembled, the light emitting device 14 of the light source unit 16 is exposed from the second opening 63 of the second frame 61. At this time, an outer edge portion 63*a* of the second opening 63 is configured to press the mounting substrate 15 of the light source unit 16 to the rear side. Further, in the inner side of the second frame 61, a reflective surface 64 is formed between the first opening 62 and the second opening 63, as an inclined surface of a conical shape inclined to be expanded toward the front side. Two reinforcement ribs 67 which are formed in a triangle thin plate are provided at the rear side (side of third frame 70) of the reflective surface 64. Two ribs 72 are provided at positions rotated by 90° about the central axis $C_L$, in addition to the two ribs 67 shown. Further, a hole 65 for screwing the flat head screw 83 is provided at the outer peripheral surface side of the second frame 61 at a position corresponding to the arm portion 52 of the first frame 51.

The third frame 70 is formed of a white resin, and includes a flat portion 71 and an outer surface portion 74 having a cylindrical shape provided outside the flat portion 71 such that a cross section of the third frame 70 has a flat H-shape. The pin 72 protruding in the rear direction is provided vertically on the rear side of the flat portion 71. Further, the groove 76 for receiving the rib 67 of the second frame 61 when the lighting device 70 is assembled is formed on the front surface side of the pin 72. In each groove 76, two wall portions 76*a* (a wall portion 76*a* at a front side of the drawing sheet is not shown) facing each other serve as engagement pieces to regulate a relative rotation between the second frame 61 (i.e., first frame 51 or main frame 60 after fixed) and the third frame 70 about the central axis $C_L$. On the other hand, in the lighting device 50, two pins 72 are provided at positions rotated by 90° about the central axis $C_L$, in addition to the two shown pins 72. The grooves 76 are provided similarly.

The outer surface portion 74 of the third frame 70 is formed to cover the substantially entire area of the outer surface of the first frame 51 and a portion of the rear side of the outer surface of the second frame 61. Further, the outer surface portion 74 is provided thereon with the engagement portions 75, as the protrusions projecting outwardly, for mounting the lighting device 50 to a housing of the apparatus body 45 when the lighting device 50 is assembled in the apparatus body 45 as shown in FIG. 2. In the lighting device 50, in addition to the two shown engagement portions 75, two engagement portions 75 are provided at positions rotated by 90° about the central axis $C_L$.

Further, in the third frame 70, the relay substrate 80 is mounted on the rear surface side of the flat portion 71. Here, the relay substrate 80 is a multilayer substrate used for electrically connecting a connector (not shown), which is disposed on a front surface 42*a* of the heat radiation member 42 of the apparatus body 45 and the light source unit 16 when the lighting device 50 is assembled in the apparatus body 45 as shown in FIG. 2. The relay substrate 80 is electrically connected to the mounting substrate 15 of the light source unit 16 through a lead line (not shown) or the like.

In the lighting device 50, the relay substrate 80 is attached to the flat portion 71 by screws (not shown) at positions corresponding to the two arm portions 53 of the first frame 51. As shown in FIG. 4, the arm portion 53 of the first frame 51 is formed with a recess portion 58 for movably accommodating the screw head of the screw for attaching the relay substrate 80 to the third frame 70 according to the relative movement between the third frame 70 and the first frame 51 (i.e., the second frame 61 or the main frame 60 after fixed).

On the other hand, as shown in FIG. 4, an electrode pattern 84 having an arc shape is formed at a rear surface side of the relay substrate 80. When the lighting device 50 is assembled in the apparatus body 45, the electrode pattern 84 and a contact having a spring property of a connector of the apparatus body 45 are in physical contact with each other, whereby the apparatus body 45, the relay substrate 80, and the light source unit 16 are electrically connected. Further, to allow such an electrical connection, the second seat portion 55 of the first frame 51 and the relay substrate 80 are set to a size such that the electrode pattern 84 is exposed at the outer side (four spaces divided by the second seat portion 55 and four arm portions 52, 53) of the second seat portion 55.

Further, the flat portion 71 of the third frame 70 is formed at its central portion with an opening 77 into which the first seat portion 54 of the first frame 51 (on which the light source unit is mounted) is movably inserted relative to the opening 77, and is formed at a position corresponding to the arm portion 52 of the first frame 51 with an opening 73 into which a convex portion 52*a* of the arm portion 52 is movably inserted relatively. Similarly, the relay substrate 80 is also provided therein with openings and/or notch portions (its reference numerals are omitted) necessary to avoid the first seat portion 54 of the first frame 51, the convex portion 52*a* of the arm portion 52, the pin 72 of the third frame 70, and the spring washer 82.

The lighting device 50 is configured by fixing the first frame 51 on which the light source unit 16 is mounted and the second frame 61 holding the Fresnel lens 66, by the flat head screws 83 in a state where the third frame 70 is sandwiched between the first frame 51 and the second frame 61. Further, the fixing is performed in a state where the spring washer 82 is arranged to the pin 72 of the third frame 70.

In the above-described lighting device 50, the main frame 60 and the third frame 70 formed by fixing the first frame 51 and the second frame 61 are connected to each other via the four spring washer 82 and become movable in the front-rear direction at each connecting position. Therefore, the lighting device 50 can achieve similar effects to those of the lighting device 10 as described above.

While the present invention has been shown and described with reference to certain illustrative embodiments thereof, it will be understood by those skilled in the art that various changes in form and details may be made therein without departing from the spirit and scope of the invention as defined by the appended claims. For example, in the above-described illustrative embodiments, it is assumed that the plurality of elastic deformation parts 36, 82 are arranged in a rotational symmetry about the optical axis $C_L$. However, in the lighting device according to the present invention, instead of being discretely arranged, one ring shaped elastic member may be arranged around the optical axis $C_L$ such that the center of the ring coincides with the optical axis $C_L$. Further, the elastic deformation parts may be arranged at the front surface side (the side of the second frames 21, 61) of the third frames 30, 70.

Further, it will be appreciated by those skilled in the art that the number or the detailed shape of the engagement portions 32, 75, the elastic deformation parts 36, 82, and screws (e.g., flat head screws 83) is not limited to the illustrative embodiments described above.

What is claimed is:

1. A lighting device comprising:

a first frame having a top surface;

a light source unit that is mounted on the top surface of the first frame and emits light toward a front direction of the lighting device;

a second frame disposed at a position in front of the first frame;

a lens having a peripheral edge being fixed to a front end portion of the second frame;

a third frame having a flat portion disposed between the first frame and the second frame and an outer surface portion extending outward from the flat portion and further extending in a front-rear direction to surround an outer periphery of the first frame; and an elastic deformation part, wherein the first frame and the second frame are fixed to each other to configure an integral main frame, and wherein the first frame includes a recess that is provided on the top surface of the first frame, the recess being configured to accommodate the elastic deformation part and the flat portion of the third frame to be in a state where the third frame is urged toward the front direction while the third frame is relatively displaceable in the front-rear direction with respect to the main frame.

2. The lighting device according to claim 1, further comprising an engagement portion for attaching the lighting device to an external housing, the engagement portion protruding outward from the outer surface portion of the third frame.

3. The lighting device according to claim 1, wherein the first frame is formed of a high thermal conductivity material.

4. The lighting device according to claim 1, wherein the elastic deformation part is arranged in rotational symmetry about an optical axis.

5. The lighting device according to claim 1, wherein the second frame has a reflective surface which is an inclined surface configured to reflect light emitted from the light source unit, the reflective surface is provided with a reinforcement rib at a side of the third frame, the third frame is provided with an engagement piece at a side of the second frame, and the engagement piece is configured to engage with the reinforcement rib to regulate a relative rotation between the main frame and the third frame.

6. The lighting device according to claim 1, wherein the third frame includes a pin protruding toward the first frame, and the elastic deformation part is a spring washer disposed to the pin.

7. The lighting device according to claim 1, wherein the lens is a Fresnel lens.

* * * * *